US008533960B1

(12) United States Patent
Barish

(10) Patent No.: US 8,533,960 B1
(45) Date of Patent: Sep. 17, 2013

(54) ELECTRICAL DEVICES, PARTICULARLY ELECTRICAL SHAVERS, HAVING MAGNETICALLY COUPLED DRIVES, AND ADAPTERS THEREFOR

(75) Inventor: Benjamin J. Barish, Tel Aviv (IL)

(73) Assignee: Dan Barish, West Bloomfield, MI (US)

( * ) Notice: Subject to any disclaimer, the term of this patent is extended or adjusted under 35 U.S.C. 154(b) by 1485 days.

(21) Appl. No.: 09/610,467

(22) Filed: Jul. 5, 2000

Related U.S. Application Data

(60) Provisional application No. 60/164,771, filed on Nov. 12, 1999, provisional application No. 60/154,034, filed on Jul. 22, 1999, provisional application No. 60/145,803, filed on Jul. 27, 1999, provisional application No. 60/142,943, filed on Jul. 12, 1999.

(51) Int. Cl.
*B26B 19/14* (2006.01)

(52) U.S. Cl.
USPC ..... 30/43.6; 30/45

(58) Field of Classification Search
USPC ..... 30/34.2, 43.6, 43.9, 43.92, 45, 32, 30/386.51, 386, 51; 74/17.8; 464/29; 463/373; 134/140, 158, 161
See application file for complete search history.

(56) References Cited

U.S. PATENT DOCUMENTS

| | | | | | |
|---|---|---|---|---|---|
| 2,241,983 | A | * | 5/1941 | Connolly | |
| 3,172,416 | A | * | 3/1965 | Simmons | |
| 3,310,693 | A | * | 3/1967 | Aronoff | |
| 3,415,195 | A | * | 12/1968 | Catterson | |
| 3,992,775 | A | * | 11/1976 | De Vries | |
| 4,509,259 | A | * | 4/1985 | Kakumoto et al. | |
| 4,532,672 | A | * | 8/1985 | Anderson | 403/349 |
| 4,653,519 | A | * | 3/1987 | Kanner | |
| 4,711,028 | A | * | 12/1987 | Bergsma et al. | |
| 4,767,378 | A | * | 8/1988 | Obermann | |
| 5,012,577 | A | * | 5/1991 | Bosch | |
| 5,376,862 | A | * | 12/1994 | Stevens | |
| 5,478,149 | A | * | 12/1995 | Quigg | 366/273 |
| 5,621,971 | A | * | 4/1997 | Szymansky | |
| 5,684,712 | A | * | 11/1997 | Goffe et al. | 366/274 |
| 5,779,359 | A | * | 7/1998 | Gambrill et al. | 366/273 |
| 6,095,677 | A | * | 8/2000 | Karkos et al. | 366/274 |
| 6,226,870 | B1 | * | 5/2001 | Barish | |

* cited by examiner

*Primary Examiner* — Stephen Choi

(57) ABSTRACT

An electrical device includes a housing having an electrical drive motor and a drive magnet mechanically coupled thereto; a sealing end wall sealing the motor and magnet within the housing; and a load device including a driven magnet magnetically coupled to the drive magnet through the sealing end wall. The driven magnet is included within a separate magnetic coupling unit attachable to and detachable from one end of the housing and mechanically coupled to the load device. The invention is particularly useful in electrical shavers for driving cutter holders. It may be embodied as an adapter for use with existing electrical shavers or other electrical devices driving loads.

5 Claims, 7 Drawing Sheets

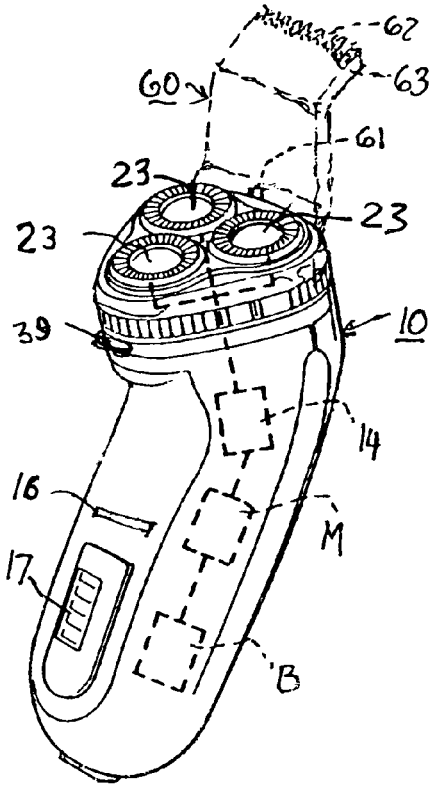
Fig.8
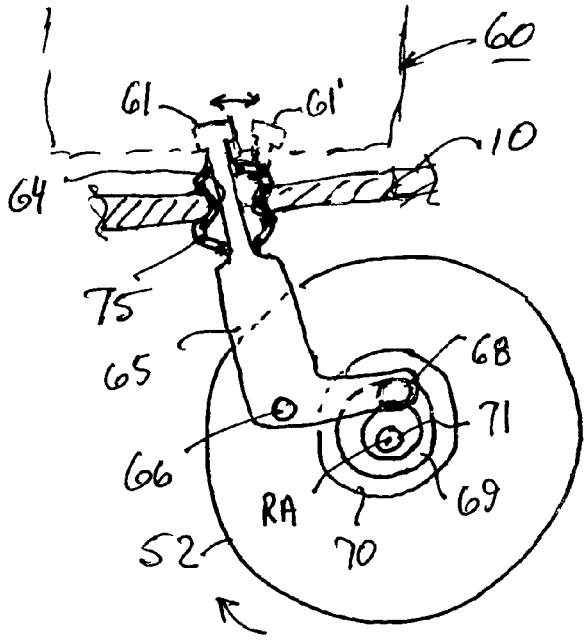
Fig. 10
Fig. 9
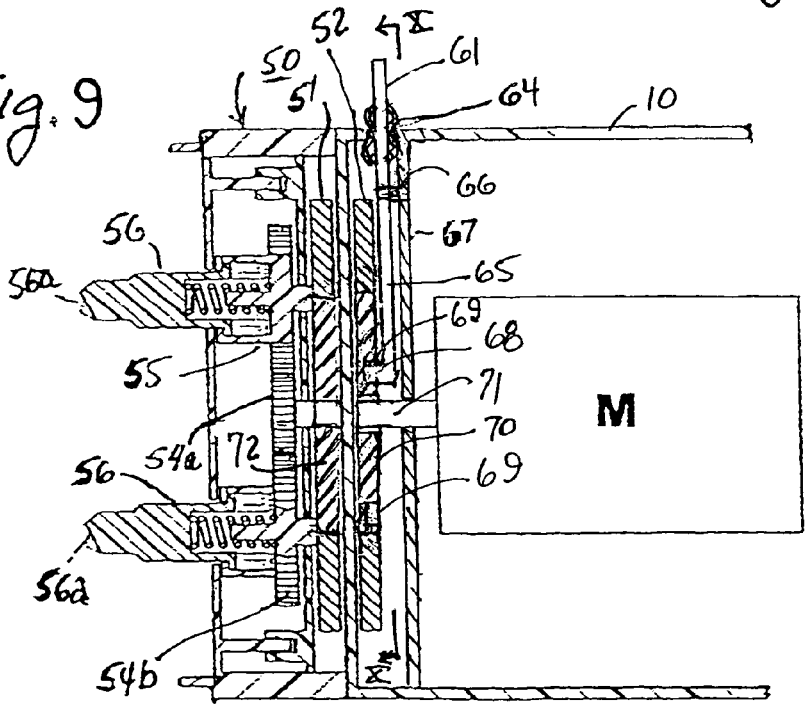

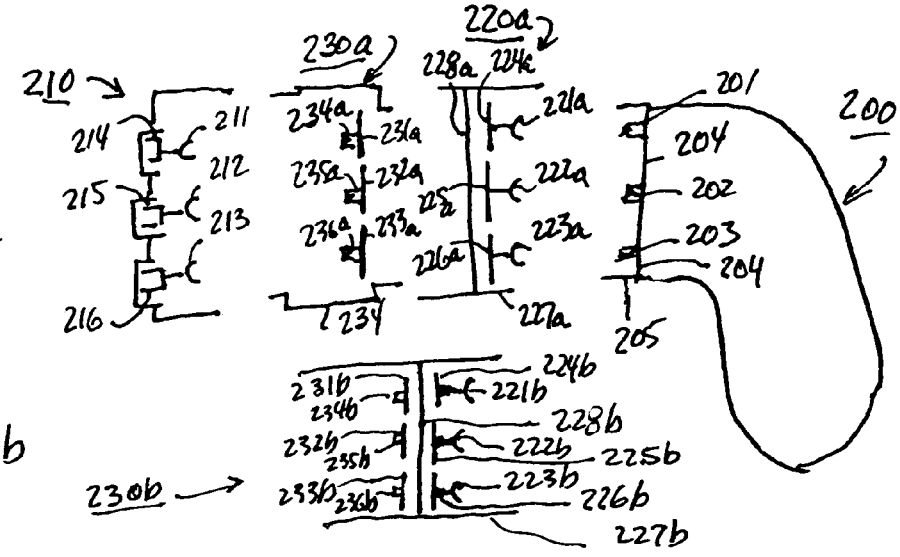
Fig.14a
Fig.14b
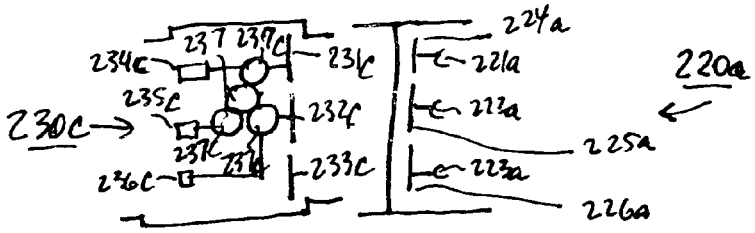
Fig.14c
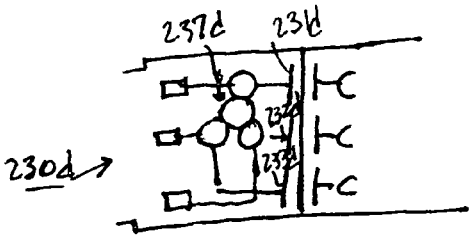
Fig.14d
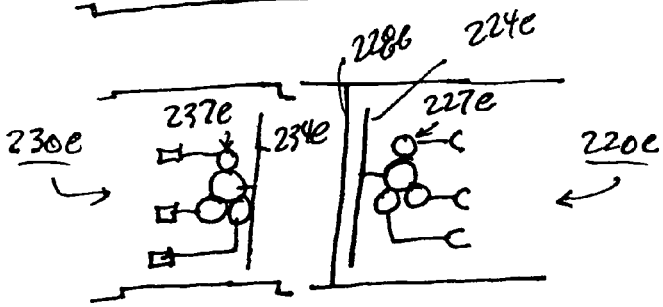
Fig.14e
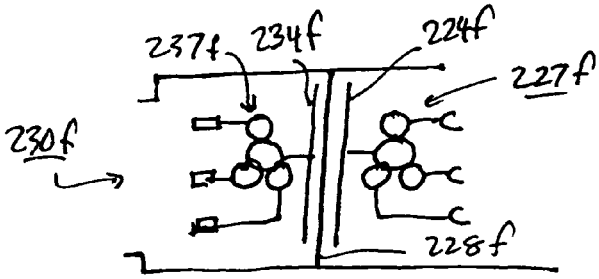
Fig.14f

ELECTRICAL DEVICES, PARTICULARLY ELECTRICAL SHAVERS, HAVING MAGNETICALLY COUPLED DRIVES, AND ADAPTERS THEREFOR

FIELD AND BACKGROUND OF THE INVENTION

The present invention relates to electrical devices having magnetically coupled drives, and particularly to electrical shavers of the type described in my U.S. patent application Ser. No. 09/312,765, filed May 17, 1999, which application issued as U.S. Pat. No. 6,226,870, which application claims the benefit of Provisional Patent Application Ser. No. 60/164,771 filed Nov. 12, 1999, Provisional Patent Application Ser. No. 60/154,034 filed Sep. 16, 1999, Provisional Patent Application Ser. No. 60/145,803, filed Jul. 27, 1999, and Provisional Patent Application Ser. No. 60/142,943, filed Jul. 12, 1999. The invention also relates to adapters for use with existing electrical devices, particularly electrical shavers, to provide a magnetic coupling enabling the motor housing of such devices to be sealed against the entry of water or other foreign substances.

My above-identified patent application describes an electrical shaver comprising a housing including a rotary electrical motor and at least one drive magnet within the housing and mechanically coupled to the electrical motor to be rotated thereby; a cutter holder externally of the motor housing and including a cutter head (preferably three); and a driven magnet externally of the housing for each drive magnet within the motor housing. The driven magnet is magnetically coupled to the respective drive magnet within the housing so as to be rotated thereby, and is mechanically coupled to the cutter heads so as to rotate them when the driven magnet is rotated by the drive magnet. As described in that patent application, the electrical motor within the housing is completely sealed from exposure to water, and therefore such an electrical shaver may be used not only for conventional dry shaving, but also for wet shaving (with soap and water) in order to produce a close shave and a clean after-feeling as when wet shaving with a blade. The contents of that patent application are incorporated herein by reference.

In the embodiments of the invention described in that patent application, the driven magnet is included in the cutter holder unit. While such a construction is capable of producing a more compact arrangement, it requires redesign of the existing cutter holder units, and therefore can not easily accommodate the many existing designs of cutter holder units.

OBJECTS AND BRIEF SUMMARY OF THE INVENTION

An object of the present invention is to provide an electrical shaver particularly of the type described in the above-identified patent application but having a number of advantages, as will be described more particularly below, particularly enabling the electrical shaver to accommodate existing designs of cutter holder units.

Another object of the invention is to provide similar advantages to other types of electrical devices, such as electrically driven pumps and valves.

A further object of the invention is to provide an adapter which may be used with existing electrical shavers, or other electrical devices, to enable such devices to be sealed against the entry of water or other foreign substances.

According to one aspect of the present invention, there is provided an electrical device, comprising: a housing shaped and dimensioned for hand-gripping by a user for manipulating the electrical device; an electrical drive motor and a drive magnet mechanically coupled thereto located within said housing; a sealing end wall carried by one end of said housing and sealing the motor and magnet within said housing; and a load device magnetically coupled to said drive magnet through said sealing end wall; characterized in that said load device is magnetically coupled to said drive magnet by a driven magnet included within a separate magnetic coupling unit clamped against separation to said one end of said housing and mechanically coupled to said load device, said magnetic coupling unit being releasably clamped to said housing against a force tending to pull apart the magnetic coupling unit from said housing during normal use of the electrical device.

According to another aspect of the present invention, there is provided an electrical shaver, comprising: a housing shaped and dimensioned for hand-grasping by a user, an electrical drive motor located within said housing; a drive magnet mechanically coupled to the drive motor through one end of said housing; a driven magnet magnetically coupled to the drive magnet; a cutter holder including a cutter head mechanically coupled to the driven magnet; and a sealing end wall between said drive magnet and the driven magnet; the driven magnet being within a separate magnetic coupling unit attachable to and detachable from said one end of the housing.

According to a still further aspect of the present invention, there is provided an adapter for use with an electrical device including a housing having an electrical motor and a drive spindle projecting through one end of the housing, and a load device to be driven by the drive spindle; the adapter being attachable between the one end of the housing and the load device and comprising: a body member attachable at one end to the one end of the housing, with the load device being attachable to the opposite end of the body member; a transverse wall extending transversely of and within the body member; a drive magnet rotatably mounted at one side of the transverse wall to be mechanically coupled to the motor drive spindle after the body member is attached to the housing; and a driven magnet rotatably mounted at the opposite side of the transverse wall to be mechanically coupled to the load device when attached to the body member. The driven magnet is thus magnetically coupled to the drive spindle by a magnetic field passing through the transverse wall to couple the load device to the motor, while the transverse wall serves as a sealing end wall with respect to the housing and the electrical motor therein.

Further features and advantages of the invention will be apparent from the description below.

BRIEF DESCRIPTION OF THE DRAWINGS

The invention is herein described, by way of example only, with reference to the accompanying drawings, wherein:

FIG. 8 illustrates an electrical shaver, such as that of FIG. 1, provided with an oscillatory-type trimmer device, which device is shown in broken lines in its operative position;

FIG. 9 is a sectional view corresponding to that of FIG. 7 but illustrating one manner of coupling the trimmer device to the electrical motor in a manner which enables the trimmer device in that embodiment also to be used during a wet shave;

FIG. 10 is a view along line X-X of FIG. 9 more particularly illustrating the coupling of the trimmer device to the electrical motor;

FIGS. 14*a*-14*f* diagrammatically illustrate a number of adapter implementations of the invention for use with existing electrical shavers or other electrical devices driving other types of loads.

DESCRIPTION OF PREFERRED EMBODIMENTS

Figure 1:
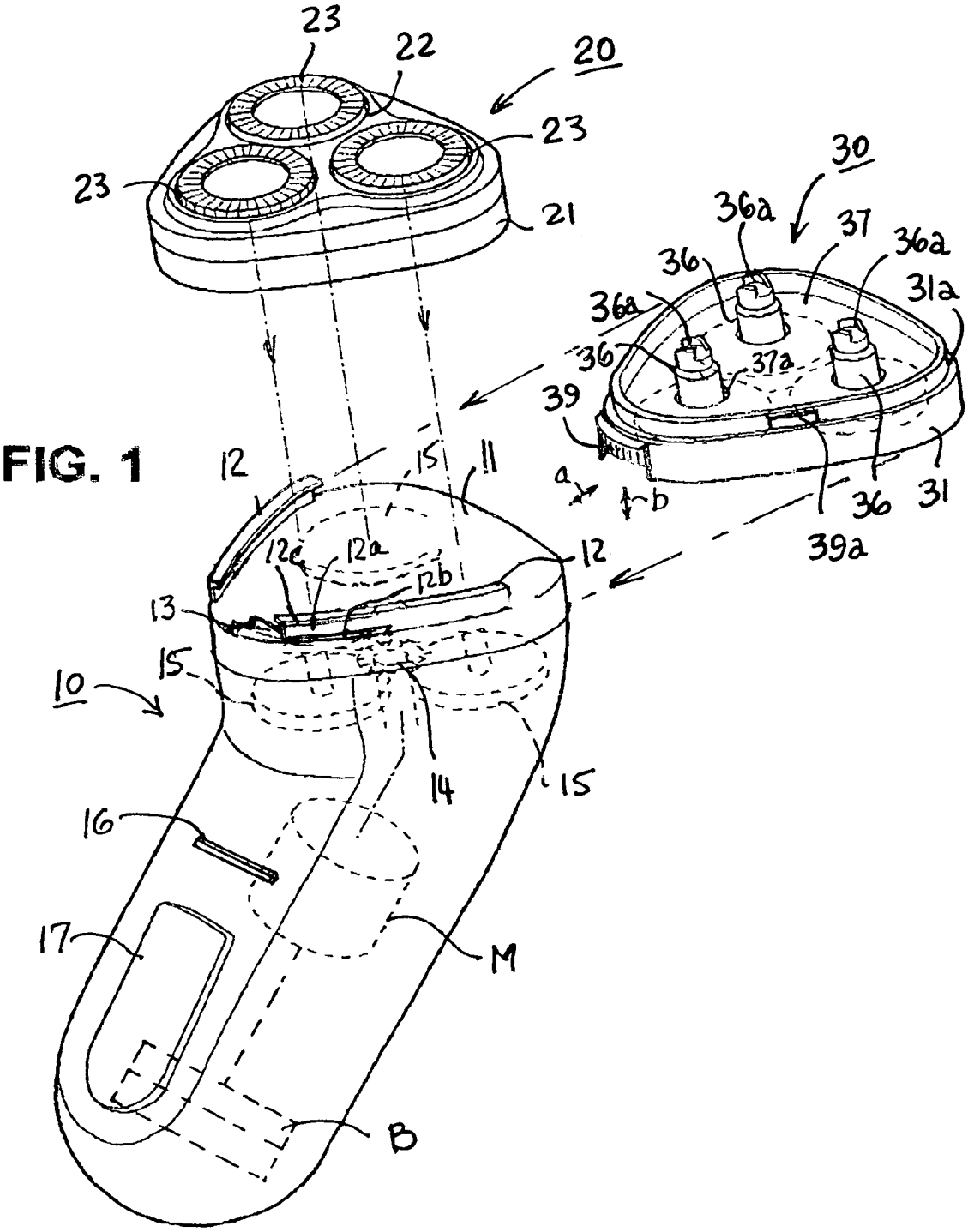
FIG. 1 is an exploded perspective view illustrating the three main units in one form of electrical shaver constructed in accordance with the present invention.
Figure 2:
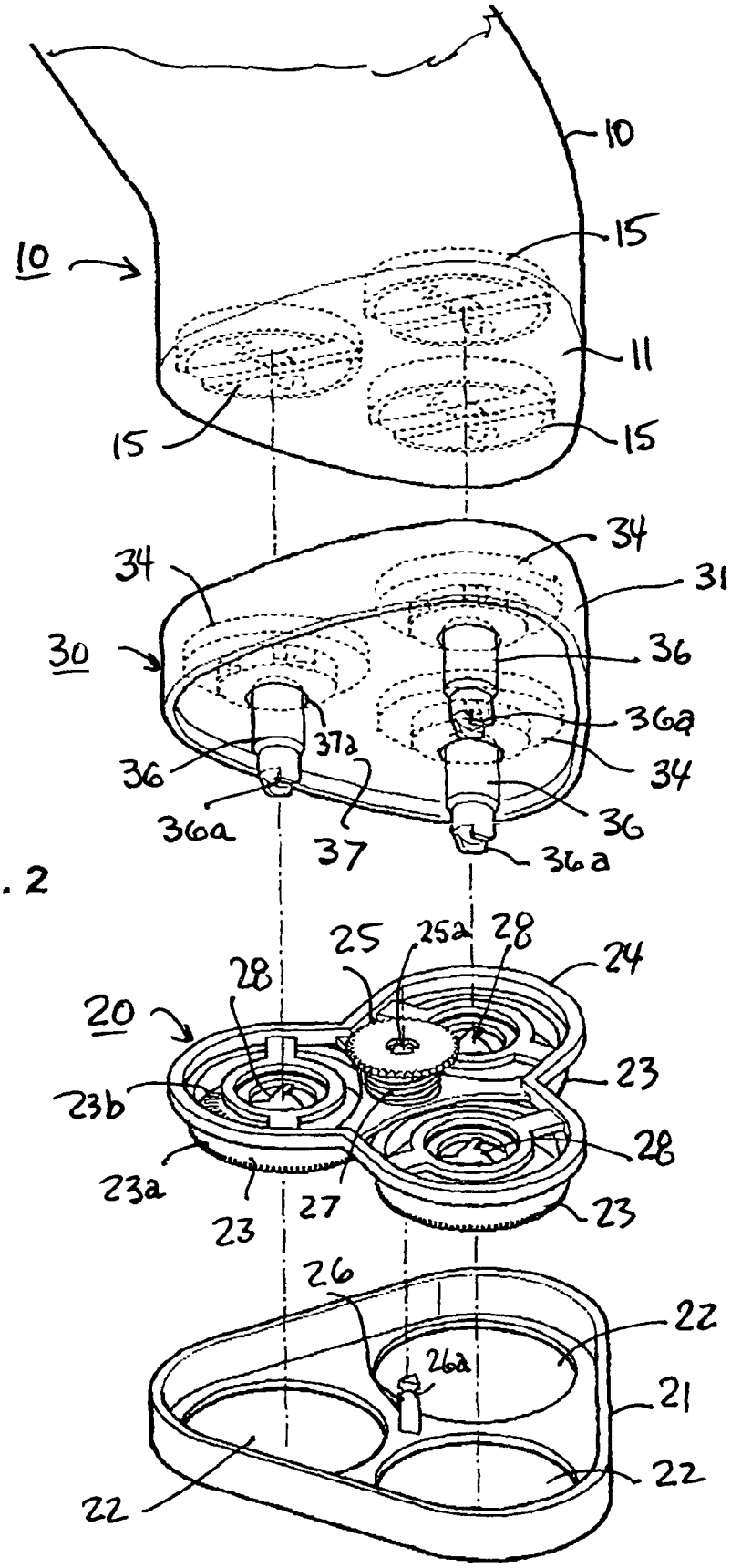
FIG. 2 is another exploded perspective view better illustrating the manner in which the main components of the three units coact.

The electrical shaver illustrated in FIGS. 1-5 of the drawings includes a motor housing 10 constructed as a separate unit; a cutter holder 20 also constructed as a separate unit; and a magnetic coupling unit 30 attachable to and detachable from one end of the motor housing 10 and, in turn, attachably and detachably receiving the cutter holder 20. When the three units 10, 20, 30 are assembled together, the magnetic coupling unit 30 effects a magnetic coupling between the electrical motor M within housing 10 and the cutter heads carried by the cutter holder 20.

Housing 10 is shaped and dimensioned for hand-grasping by a user for manipulating the electrical device and is hermetically sealed so as to protect the motor M and the rechargeable battery B within the housing from penetration of water, dirt, etc. The housing end receiving the magnetic coupling unit 30 is closed by a sealing end wall 11. End wall 11 is provided with a pair of inturned flanges 12 for receiving the magnetic coupling unit 30, and with a resilient clip 13, cooperable with a recess on the underside of the magnetic coupling unit 30 for releasably retaining the magnetic coupling unit attached to the housing 10.

The two inturned flanges 12 converge towards one end 12*a*, normally the end facing the user when using the shaver. Each flange is formed with a pair of parallel longitudinal slots 12*b*, 12*c* extending for a part of its length from its end 12*a* to impart elasticity to the respective end 12*a* of the flanges. As will be described below, such an arrangement facilitates the attachment and detachment of the magnetic coupling unit 30 with respect to the housing 10.

Figure 3:
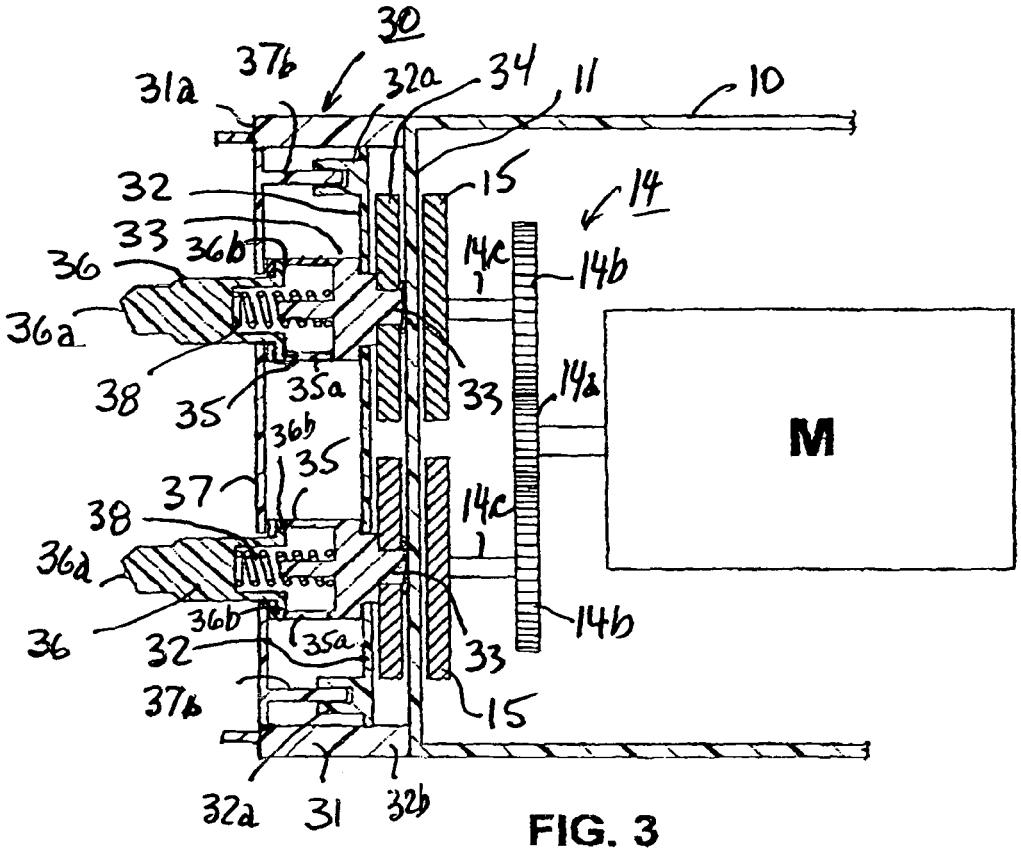
FIG. 3 is a sectional view particularly illustrating the magnetic coupling unit attached to the housing.

The cutter holder 20 has three cutter heads. In the construction of FIGS. 1-5, motor M within housing 10 is coupled by mechanical gearing, generally designated 14, to three disc-type drive magnets 15 located close to the inner face of end wall 11. As shown in FIG. 3, gearing 14, which may be basically the same as in the present commercial three-head electrical shaver of this type, includes a drive gear 14*a* coupled to the motor M and meshing with three driven gears 14*b*, each coupled by a spindle 14*c* to its respective drive magnet 15. Since the cutter holder 20 includes three cutter heads, each to be rotated by the motor M, the housing 10 would similarly include three gears 14*b* and three drive magnets 15 (only two of which are seen in FIG. 3).

Housing 10 may otherwise be constructed as in any of the commercial versions of this type of electrical shaver, to include a switch 16 for energizing the electrical motor M, and a display 17 for indicating the charge status, etc. of the rechargeable batteries B.

An important feature of the present invention is that the cutter holder 20 may be any one of the constructions presently available in the rotary type electrical shaver. For purposes of example, the illustrated cutter holder 20 includes a body member 21 of generally triangular configuration formed with three large openings 22 for receiving the three cutter heads 23. Each cutter head 23 is constituted of a fixed shear member 23*a* (FIG. 2) formed with hair-receiving slots, and a rotary shear member 23*b* rotatable within the fixed shear member 23*a*. The three cutter heads 23 are retained within the body member 21 by a retainer 24 having three lobes each engageable with an annular flange formed in the fixed shear member 23*a* to press it against the end wall of the body member 21. Retainer 24 includes a rotatable knob 25, having a shaped bore 25*a* receiving the notched end 26*a* of an upstanding pin 26 on body member 21, for releasably retaining the retainer member, and thereby the cutter heads 23, within body member 21. A spring 27, between knob 25 and the end wall of body member 21, permits each cutter head 23 to move within its respective opening 22 to more closely conform to the outer contour of the surface being shaved. Ribs 28 formed in the hub of each rotary cutter member 23*b* serve to couple each rotary cutter member to the electrical drive.

While one particular construction of cutter holder 2 is illustrated in the drawings, it will be appreciated that this is set forth merely for purposes of example, and that other cutter holder constructions could be used.

Whereas in the conventional electrical shaver, each rotary cutter member 23*b* is mechanically coupled via its hub ribs 28 to the electrical drive, in the electrical shavers described in the above-identified Patent Application, as well as in the present application, the coupling of the rotary cutter members 23*b* is effected via a magnetic coupling to the electrical drive, rather than a mechanical coupling, to thereby enable the interior of the motor housing 10 to be hermetically sealed against the penetration of water, soap, cut hairs, or other substances. In the above-identified Patent Application, this magnetic coupling is effected by permanent magnets mounted within the cutter holder 20; in the constructions described in the present application, the magnetic coupling is effected by the separate magnetic coupling unit 30 which is provided between the housing 10 and the cutter holder 20, and which thereby enables conventional cutter holders to be used.

The magnetic coupling unit 30 also includes a body member 31 of the same triangular configuration as body member 21 of cutter holder 20. In addition, it is formed with a peripheral ledge 31*a* (FIG. 1) for receiving the inturned flanges 12 of the housing 10 when attaching the magnetic coupling unit 30 to the housing.

As shown particularly in FIG. 3, body member 31 of the magnetic coupling unit is formed with a transverse wall 32 having three openings therein for rotatably receiving three pins 33. On one side of transverse wall 32, each pin 33 is fixed to a magnetic disc 34 magnetically coupled to a magnetic disc 15 within the motor housing 10. The opposite side of each pin 33 is formed with a socket 35 telescopically receiving a coupling pin 36 formed at its outer end with teeth 36*a* to engage ribs 28 of the respective rotary cutter member 23*b* (FIG. 2) for rotating the cutter member.

A second transverse wall 37 in body member 31 is formed with three openings 37*a* (FIG. 2) for accommodating the coupling pins 36. Openings 37*a* are of slightly larger diameter than pins 36 to provide clearances permitting some axial and lateral movements of the pins with respect to wall 37. Wall 37 is removably attached to wall 32 in any suitable manner, e.g., by studs 37*b* in wall 37 force-fitted within sockets 32*a* in wall 32, or by screws (not shown). A spring 38 between each pair of pins 36 and 33 urges the coupling pin 36 outwardly of wall 37.

Body member 31 further includes a button 39 (FIG. 1) facing the user while using the electrical shaver. Button 39 is movable in a first direction (e.g., inwardly as shown by arrow a) to release a catch 39*a* in order to permit detachment of the cutter holder 20, and in a second direction, (e.g., downwardly as shown by arrow b) to depress retainer clip 13 of the housing 10 in order to permit detachment of the magnetic coupling unit 30 from the housing.

Pins 33, 36 for each of the cutter heads 23, thus serve as a two-part drive spindle, or rotatable coupling, between the respective driven magnet 34 and the cutter head, which coupling is yieldable in the axial direction to permit inward and outward displacement of the cutter head within the cutter body member 21. The rotary coupling is effected by teeth 36*b* in each coupling pin 36 receivable within axial slots 35*a* formed in the respective socket 35; whereas the axial yieldability is permitted by spring 38, as in the existing electrical shaver coupling between the electrical motor and the cutter heads.

Figure 4:
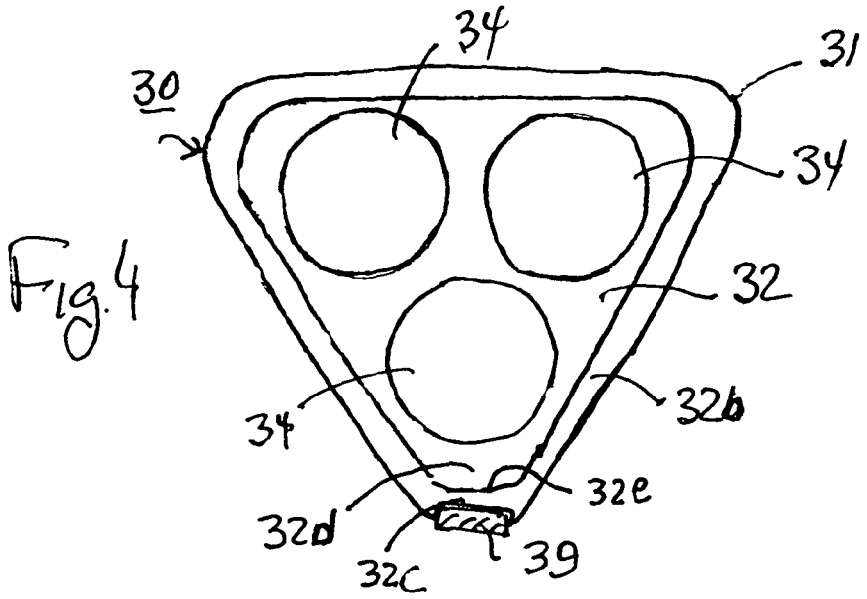
FIG. 4 is a view of the magnetic coupling unit from the end facing the housing.
Figure 5:
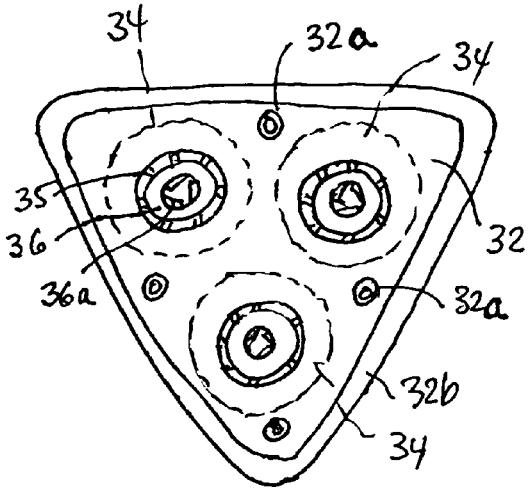
FIG. 5 is an end view of the magnetic coupling unit from the end facing the cutter holder, with the outer wall of the magnetic coupling unit removed to show the internal structure.

As indicated earlier, FIG. 4 illustrates the end of the magnetic coupling unit 30 facing the housing 10; whereas FIG. 5 illustrates the end of the magnetic coupling unit facing the cutter holder 20 but with the outer wall 32 removed to better show the internal structure. Thus, the end of the magnetic coupling unit 30 facing the cutter holder 20 (with wall 37 present) has the same "footprint" as the respective end of the shaver housing facing the cutter unit 20, so that the commercially-available cutter units 20 presently used for conventional dry shaving can also be used in an electrical shaver equipped with the magnetic coupling unit 30 in accordance with the present invention for wet or dry shaving.

As shown in FIGS. 3 and 4, the transverse wall 32, rotatably mounting the three magnetic discs 34 and their respective pins 33, 36, is formed with a peripheral wall 32*b* circumscribing the three magnetic discs and projecting slightly past the outer faces of those discs wall 32*b* is dimensioned to engage the end wall 11 of the housing 10, when the magnetic coupling unit 30 is applied thereto and to closely space the magnetic discs from that end wall. Peripheral wall 32*b*, which thus defines a recess for the three magnetic discs 34, has a flat outer surface enabling it to be slid over the housing end wall 11 when attaching the magnetic coupling unit 30 to the housing. At the end of the sliding movement of unit 30 when being attached to the housing, the apex portion 32*c* (FIG. 4) of peripheral wall 32*b* engages and depresses the retainer clip 13 and permits that clip to snap into the recess 32*d* (FIG. 4) inwardly of apex portion 32*c* to retain the magnetic coupling unit attached to the housing.

The electrical shaver illustrated in FIGS. 1-5 is used in the following manner.

The magnetic coupling unit 30 may first be attached to the motor housing 10 by aligning the apex end of the coupling unit carrying the release button 39, with the center of the opposite end of housing 10, as shown in FIG. 1, and sliding the coupling unit 30 transversely with respect to the housing to cause the inturned flanges 12 of the housing to seat on the annular ledge 31*a* of the magnetic coupling unit. The peripheral wall 32*b* closely spaces the magnet discs 34 from the housing end wall 11 when the magnetic coupling unit 30 is thus applied. The two inturned flanges 12, and particularly the elastic end portions 12*a* defined by the slots 12*b*, 12*c*, are slightly stressed during the final insertion movement of the magnetic coupling disc 20. As the magnetic coupling unit is moved into full alignment with housing 10, retainer clip 13 of the housing snaps into the recess 32*d* (FIG. 4) in the underside of the magnetic coupling unit 30 and engages shoulder 32*e* defined by the apex portion 32*c* of wall 32*b*, to firmly retain the unit attached to the housing.

The magnetic coupling unit 30 may be detached from the housing by reversing this transverse movement. Thus, depressing button 39 releases clip 13, thereby permitting the prestressed elastic portions 12*a* of the inturned flanges 12 to move the magnetic coupling unit 20 slightly away from clip 13, such that the magnetic coupling unit may then be grasped and slid outwardly of the housing 10 from between the inturned flanges 12.

This manner of attaching and detaching the magnetic coupling unit 30 to the housing 10 thus produces a transverse movement of the magnetic discs 34 of the coupling unit with respect to magnetic discs 15 within the housing. Such a transverse movement is less resisted by the magnetic force produced between these magnets than an axial movement as would be involved in pulling off the magnetic coupling unit from the housing by an outward movement rather than a transverse movement.

When the magnetic coupling unit 30 has been attached to housing 10, the cutter holder 20 may be attached to unit 30 in the same manner as in the conventional commercial construction, by merely pressing the cutter holder against the coupling unit 30, which causes the catches 39*a* of the magnetic coupling unit to engage shoulders (not shown) in the cutter holder. To detach the cutter holder, button 39 is pressed inwardly to release the catches 39*a*, also as in the conventional commercial construction.

After use, both the magnetic coupling unit 30, and the cutter holder 20 attached to it, can be released together (e.g., for water rinsing after a wet shave) by merely pressing down on button 39 to depress clip 13, which thereby permits the two units to be moved together transversely of the housing 10 and to be removed in the manner described above. If it is desired, however, only to remove the cutter holder, without removing the magnetic coupling unit 30, this may be done by merely pressing button 39 inwardly, which releases the catches 39*a* to permit removal of the cutter holder 20 as in the conventional construction.

The electrical shaver illustrated in FIGS. 1-5 thus permits conventional cutter holders 20 to be used in an electrical shaver having a sealed housing so that the shaver can be used for wet shaving as well as for dry shaving. The transverse walls 32 and 37 may be formed with additional openings to facilitate air cleaning, rinsing and/or drying.

Figure 6:
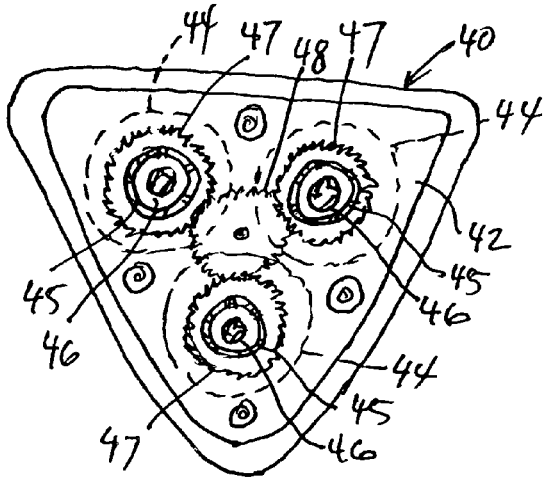
FIG. 6 is a view similar to that of FIG. 5, but illustrating a modification in the construction of the magnetic coupling unit to minimize variations in speed with variations in load.

FIG. 6 is a view similar to that of FIG. 5 but illustrates a modification in the construction of the magnetic coupling unit, therein designated 40. In this modification, the body member 41 of the magnetic coupling unit also includes a transverse wall 42 for rotatably mounting the three magnetic discs 44 on one side (to face the housing unit 10), and the sockets 45 and pins 46 on the opposite side, corresponding to sockets 35 and pins 36 in FIG. 5, to face the cutter unit 20. In this case, however, each socket 45 has a circular gear 47 fixed to it so as to be rotated with the respective magnetic disc 44, socket 45 and pin 46. The gears 47 for the three magnetic discs 44 all mesh with a center gear 48 rotatably mounted on transverse wall 42. Such an arrangement thus provides a gear assembly, similar to gear assembly 14 within the housing 10, mechanically coupling together all the driven magnetic discs 44, their drive pins 46, and the cutter heads driven by those pins. This arrangement thereby increases the flywheel inertia of the cutter heads to produce a more uniform rotation of each cutter head and to make its rotation less sensitive to changing loads on the respective cutter head.

Figure 7:
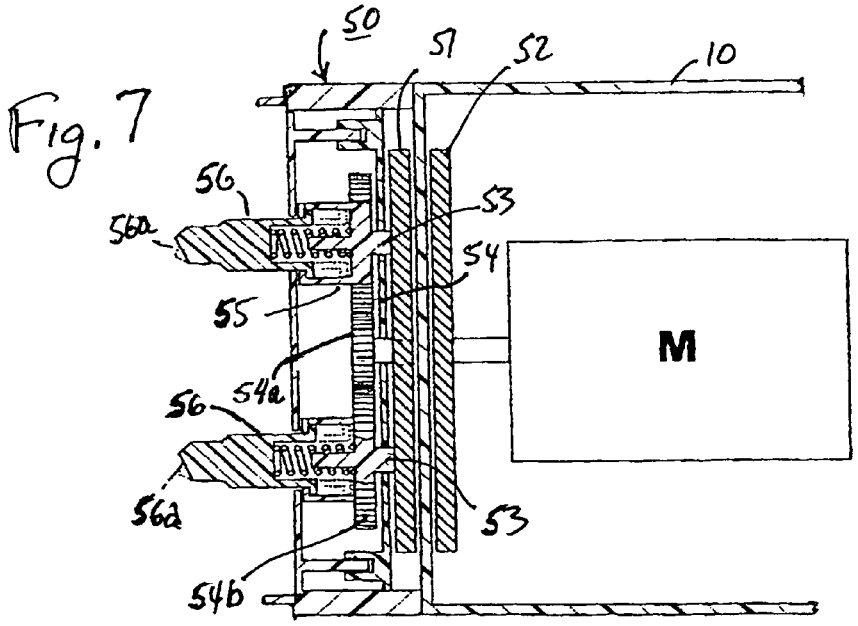
FIG. 7 is a sectional view corresponding to that of FIG. 3 but illustrating another embodiment of the invention.

FIG. 7 illustrates another embodiment of the invention in which the magnetic coupling unit, therein designated 50, is of a slightly different construction to accommodate only a single disc-type driven magnet 51 cooperable with a single disc-type drive magnet 52 coupled to the motor M within the housing 10.

Thus, in FIG. 7, the gearing, corresponding to gearing 14 in FIG. 1, coupling the motor M to the three cutter heads in the cutter holder 20, is located not within housing 10 as in FIG. 3, but rather is rotatably mounted to a transverse wall 54 within the magnetic coupling unit 50. This gearing includes a center drive gear 54*a* fixed to the driven magnet 51, and three driven gears 54*b* each fixed to one of the coupling pins 53 and meshing with gear 54*a* to provide the rotary, yieldable coupling to the respective shaver head. In substantially all other respects, the construction illustrated in FIG. 7 is the same as described above with respect to FIGS. 1-5 and provides the same advantages.

The construction illustrated in FIG. 7 thus: reduces the number of parts by requiring only two large-diameter magnetic discs (51, 52) rather than six small-diameter discs; permits maximizing the coupling force with minimum magnetic material; and increases the "flywheel" inertia of the cutter heads to produce a more uniform rotational speed of each cutter head despite variations in their respective loads.

Electrical shavers of the rotary type described herein are frequently provided with trimmer devices in the form of oscillatory-type cutters for trimming side burns, mustaches, beards, and the like. FIG. 8 illustrates such a trimmer device, therein generally designated 60, included in the Philips "Philishave" Model 930. Such a trimmer device is pivotally mounted to the housing 10 to a non-operative position received within a recess (not shown) in the housing, or to an operative position shown in the broken lines in FIG. 8. The trimmer device is driven by a drive stem (shown schematically at 61 which is oscillated by the motor M within housing 10, and which transmits its oscillations to a toothed cutter member 62 to oscillate that member with respect to a toothed shear member 63. Since the structure of such trimmer devices is well known, further details of its construction and operation are not set forth except to describe how the magnetic coupling arrangements described herein can be used for driving the drive stem 61, and for sealing it against the entry of water, when the electrical shaver is used in a wet shaving process.

When using three drive magnets and three driven magnets (FIGS. 1-6), the same type of mechanism may be used for driving the stem 61 as in the present commercial version of the electrical shaver, it only being necessary to seal the stem 61 with respect to its opening in housing 10. This is not a difficult sealing problem because of the short reciprocatory movements of the drive stem 61 (as compared to the sealing problem involved with respect to the rotary movements of the cutter heads).

FIGS. 9 and 10 illustrate how the drive stem 61 may be driven in the FIG. 7 construction wherein the magnetic coupling includes a single drive magnet 52 and a single driven magnet 51. As shown, the drive stem 61 passes through a slot-type opening 64 within housing 10 for coupling to the vibratory cutter member 62 of the trimmer device 60. Drive stem 61 is integrally formed as one arm of a lever 65 pivotally mounted at 66 to a wall 67 within housing 10. The opposite end of lever 65 carries a pin 68 movable within a circular slot 69 formed in a plastic hub 70 fixed to the drive magnet 52. Hub 70 is fixed to the motor drive spindle 71 which defines the axis of rotation of the drive magnet.

As seen particularly in FIG. 10, the circular slot 69 formed in hub 70 is eccentric with respect to the axis of rotation RA defined by the drive spindle 71. Accordingly, as the drive magnet 52 is rotated, pin 68 received within the circular slot 69 will oscillate the drive stem 61 back and forth, as shown by the limit positions 61, 61', about pivot 66, and thereby rapidly reciprocate the drive cutter member 62 (FIG. 8) of the trimmer device 60 with respect to the shear member 63.

Since the movements of drive stem 61 with respect to the housing 10 are short oscillating movements, the sealing of the drive stem with respect to the housing may use a relatively simple type of seal, such as shown at 75 in FIG. 10. Other sealing arrangements are known and can be used.

For purposes of symmetry and weight reduction, the driven magnetic disc 51 may also be provided with a plastic center hub 72 corresponding to hub 70 in the drive magnetic disc 52. Alternatively, the circular slot 69 may be formed directly in the drive magnetic disc 52.

Figure 11:
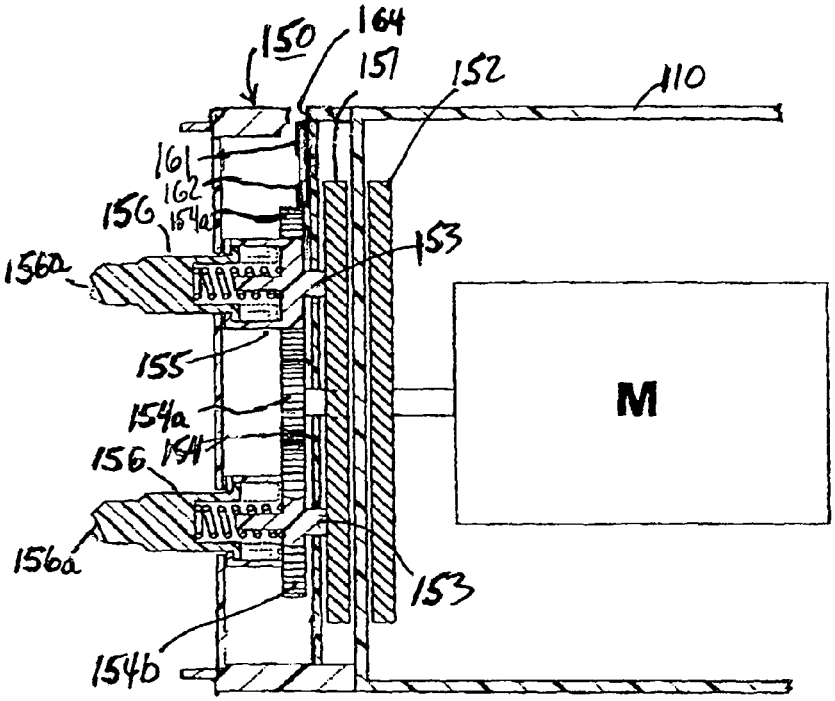
FIG. 11 is a view, similar to that of FIG. 7, but illustrating coupling the vibratory-type trimmer device via mechanism within the magnetic coupling unit, thereby enabling the motor housing to be completely sealed.
Figure 12:
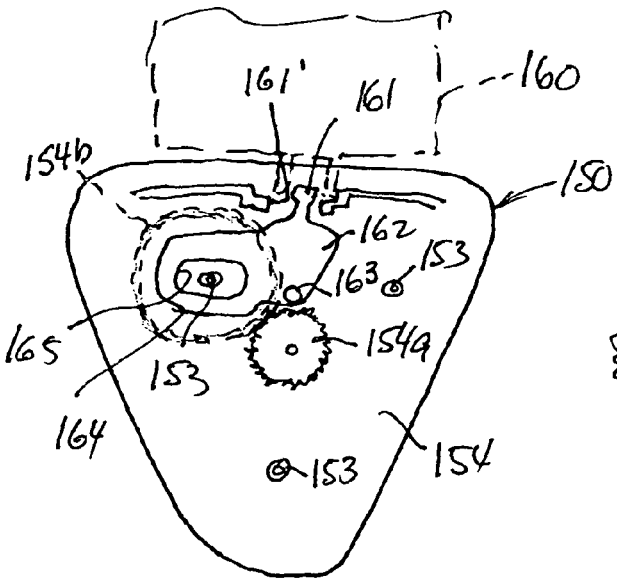
FIG. 12 is a view illustrating the oscillatory mechanism within the magnetic coupling unit of FIG. 11.
Figure 13:
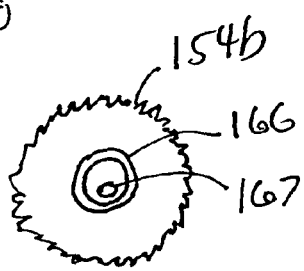
FIG. 13 illustrates the face of each of the rotary gears in FIG. 11 cooperable with the oscillatory mechanism of FIG. 12.

FIGS. 11-13 illustrate a further embodiment of the invention wherein the oscillatory cutter device is driven by an oscillatory mechanism within the magnetic coupling unit, rather than within the motor housing, thereby enabling the motor housing to be completely sealed against the penetration of water, dirt, etc. The oscillatory mechanism illustrated in FIGS. 11-13 is basically the same as that now included in the Philips "Philishave" Model 930 referred to above, except that instead of being provided in the motor housing 10, it is provided within the magnetic coupling unit.

As shown in FIG. 11, the magnetic coupling unit illustrated therein is very similar to magnetic coupling unit 50 illustrated in FIG. 7, and therefore corresponding parts are identified by the same reference numerals except increased by "100". Thus, the magnetic coupling unit illustrated in FIG. 11, therein generally designated 150, is removably attachable to the motor housing 110 in the same manner as described above, and rotatably mounts a driven magnet 151 magnetically coupled to the drive magnet 152 within the motor housing. Driven magnet 151 is mounted on one side of wall 154 and rotates a center gear 154*a* mounted on the opposite side of wall 154. Gear 154*a* meshes with three gears 154*b* each driving, via the two-part drive spindles 155, 156 and teeth 156*a*, one of the cutter heads (23, FIG. 1) of the cutter holder (20, FIG. 1) in an axially-yieldable manner as described above.

In the embodiment illustrated in FIGS. 11-13, the oscillatory cutter device, schematically indicated by broken lines 160 in FIG. 12, is driven by a drive stem 161 within the magnetic coupling unit 150, rather than within the motor housing 110 as in the present commercial version referred to above. Thus, whereas in the commercial version, this mechanism is driven by one of the output gears driven by the center gear coupled to the motor drive spindle, in the embodiment illustrated in FIGS. 11-13 the drive stem 161 is oscillated within a slot 161' in the magnetic coupling unit 150 by one of the gears 154*b* driven via center gear 154*a* by the driven magnet 151.

The oscillatory mechanism is more particularly illustrated in FIG. 12. It includes a bell crank lever 162 pivotally mounted at 163 to wall 154 of the magnetic coupling unit 150. One arm of lever 162 is defined by the drive stem 161, whereas its arm 164 on the opposite side of pivot 163 is formed with an elongated slot 165. This slot receives a cylindrical pin 166 (FIG. 13) formed in the confronting face of one of the three rotatably mounted gears 154*b*. As shown particularly in FIG. 13, cylindrical pin 166 in gear 154*b* is eccentric with respect to the rotary axis of gear 154*b* as defined by pin 167 of the gear received within bore 153 of wall 154. Slot 165 in lever 162 has a width equal to the outer diameter of the cylindrical pin 166 on gear 154*b*, and a length larger than its width. The arrangement is such that when the gear rotates about its axis defined by its pin 167 and bore 153 of wall 154, cylindrical pin 166 moves along the inner surface of slot 165 to oscillate lever 162, and thereby to drive stem 161, through a forward stroke and a return stroke with each rotation of gear 154*b*.

The oscillatory cutter device, schematically shown by broken lines 160 in FIG. 12 (and 60 in FIG. 8), is pivotally mounted to the motor housing 110 such that in the operative position of the cutter device (as shown in FIG. 8), its movable cutter member (corresponding to 63, FIG. 8) would be coupled to drive stem 161 so as to be oscillated thereby with respect to its shear member (63, FIG. 8), as in the above-referenced commercial model of electrical shaver, except that the oscillating mechanism is provided in the magnetic coupling unit 150, rather than in the motor housing 110. Accordingly, the embodiment illustrated in FIGS. 11-13 includes basically the same parts as in the above-referenced commercial shaver, requiring substantially only the addition of the drive magnet, the driven magnet, their mountings and the hermetically sealed end wall of the motor housing, to enable the shaver to be used for both wet shaving and dry shaving.

The above-described embodiments of the invention thus enable existing cutter holders to be used; however, they require some modification of the motor housing in the existing designs. FIGS. 14*a*-14*f* diagrammatically illustrate a number of embodiments of the invention in the form of adapters for use with existing electrical shavers, in which the adapter is attachable between the housing and the cutter holder and does not require any modification in either.

Thus, FIG. 14*a* illustrates a commercial electrical shaver including a housing 200 carrying an electrical motor and a transmission for driving three spindles 201, 202, 203 projecting through an end wall 204 circumscribed by a peripheral wall 205 of the housing; and a cutter holder 210 removable attachable to housing 200 and provided with three hubs in the form of sockets 211, 212, 213, each carried by a rotary cutter member 214, 215, 216 to be driven by the spindles 201-203 when the cutter holder 210 is attached to the end of the housing 200. FIG. 14*a* also illustrates an adapter, constituted of two units 220*a*, 230*a*, releasably attachable to each other, and also releasably attachable between the housing 200 and the cutter holder 210, to enable the electrical shaver also to be used for wet shaving (i.e., with soap and water) without the danger of the water penetrating into the housing 200 and wetting the motor or the electrical circuitry therein.

Unit 220*a* of the two-unit adapter illustrated in FIG. 14*a* is in the form of a cap to be attached to the end of motor housing 200. One side has the same "footprint" as the cutter holder 210 facing housing end wall 204. Thus, unit 220*a* includes hubs 221*a*-223*a* to be mechanically coupled to the spindles 201-203 of the motor housing 200 instead of hubs 211-213. Each hub 221*a*-223*a* is fixed to a magnetic disc 224*a*-226*a* rotatably mounted within a body member 227*a* on one side of a wall 228*a* extending transversely of the body member. The arrangement is such that when body member 227*a* is attached to peripheral wall 205 of the motor housing 200, spindles 201-203 are received within hubs 221*a*-223*a*, respectively, to rotate the magnet discs 224*a*-227*a*, while the transverse wall 228*a* serves as a sealing end wall with respect to the housing 200 and the electrical motor therein.

Unit 230*a* in FIG. 14*a* generally corresponds to the magnetic coupling unit, (e.g., 30, FIG. 1), of the above-described embodiments and has the same "footprint" as housing end wall 204 facing cutter holder 210. Thus, unit 230*a* includes three magnetic discs 231*a*-233*a* adapted to be located on the outer side of the transverse wall 228*a*, when unit 230*a* is attached to unit 220*a*, with each magnetic disc having a spindle 234*a*-236*a* to be received within the hubs 211-213 of the cutter holder 210 when attached to the magnetic coupling unit 230*a*.

Unit 230*a* may be attached to unit 220*a* by inturned flanges corresponding to flanges 12 in FIG. 1. However, other attachments may be used, e.g., a threaded attachment, a partial-turn, bayonet-type pin-and-slot attachment, etc.

It will thus be seen that when the two units 220*a* and 230*a* are attached together between the motor housing 200 and the cutter holder 210, transverse wall 228*a* serves as a sealing end wall preventing water or other foreign substances from entering the interior of the motor housing 200, while the magnets 224*a*-226*a* and 234*a*-236*a* serve as magnetic couplings for coupling the drive motor within housing 200 to the rotary cutter members 214-216 of the cutter holder 210. Making the adapter in the two-unit form illustrated in FIG. 14*a* enables the magnetic coupling unit 230*a* to be conveniently separated with the cutter holder 210 from housing 200 for cleaning, e.g., by rinsing under water, while the cap unit 220*a* is retained on the housing end.

FIG. 14*b* illustrates an arrangement wherein the adapter is constituted of a single unit 230*b* including a single body member 227*b* having a transverse wall 228*b* serving as the sealing end wall when the adapter is applied to the motor housing. Thus, three magnetic discs 224*b*-226*b* mounted at one side of the transverse wall 228*b*, with each disc having a hub 221*b*-223*b* for receiving the spindles 201-203 of the motor housing 200. Unit 230*b* further includes three magnetic discs 231*b*-233*b* rotatably mounted on the opposite side of the transverse wall 228*b*, each carrying a spindle 234*b*-236*b* receivable within the hubs 211-213 of the cutter holder 210, when unit 220*b* is attached between the motor housing 200 and the cutter holder 210.

FIG. 14*c* illustrates an arrangement similar to that of FIG. 14*a*, except that in the magnetic coupling unit, therein designated 230*c*, the drive magnets 231*c*-233*c* are coupled together by gears 237 and 237*a*-237*c*, so as to increase the "flywheel" inertia of the cutter heads to produce a more uniform rotational speed of each cutter head during the variations in the load. The adapter in FIG. 14*c* may otherwise be of the same construction as described above with respect to 14*a*, and therefore the remaining parts have been correspondingly numbered to facilitate understanding.

FIG. 14*d* illustrates a single-unit adapter 230*d* similar to that of FIG. 14*b*, but including the gearing generally designated 237*d*, coupled to the driven magnets 231*d*-233*d*, to increase the flywheel inertia of the cutter heads as in FIG. 14*c*.

FIG. 14*e* illustrates a two-unit adapter, similar to FIGS. 14*a* and 14*c*, but including a single drive disc 224*e* on one side of the sealing end wall 228*e* in the cap unit 220*e*, and a single driven disc 234*e* in the magnetic coupling unit 230*e* to be located on the opposite side of the sealing end wall. In this case, the drive magnet 224*e* in unit 220*e* is coupled via gearing 227*e* to the three spindles (201-203, FIG. 14*a*); and the single driven disc 234*e* in unit 230*e* is coupled, via gearing 237*e*, to the three rotary cutter members (214-216, FIG. 14*a*).

FIG. 14*f* illustrates an arrangement similar to FIG. 14*e*, except in a one-unit construction 230*f*, similar to that of FIG. 14*d*, in that it includes a single drive disc 224*f* on one side of the transverse wall 228*f*, and a single driven disc 234*f* on the opposite side of the transverse wall. Drive disc 224*f* is driven, via gearing 227*f*, by the three spindles (201-203, FIG. 14*a*) of the motor housing; and the three rotary cutter members (214-216, FIG. 14*a*) of the cutter holder are driven by the driven disc 234*f* via gearing 237*f*.

While the invention has been described with respect to several preferred embodiments, it will be appreciated that these are set forth merely for purposes of example, and that many other variations, modifications and applications of the invention may be made.

What is claimed is:

1. An electrical device comprising: a housing shaped and dimensioned for hand-gripping by a user for manipulating the electrical device; an electrical drive motor and a drive magnet mechanically coupled thereto located within said housing; a sealing end wall carried by one end of said housing and sealing the motor and magnet within said housing; and a load device magnetically coupled to said drive magnet through said sealing end wall; characterized in that said electrical device is an electrical razor designed for normal use to remove hairs from a subject's skin, and in that said load device is releasably clamped against separation to said one end of said housing by a force tending to pull apart the load device from said housing during normal use of the electrical razor.

2. The electrical device according to claim 1, wherein said sealing end wall of the housing includes a pair of inturned flanges on its opposite sides for detachably clamping said magnetic coupling unit by a transverse sliding movement of the load device with respect to said end wall of housing.

3. The electrical device according to claim 1, wherein said housing is formed with said sealing end wall at one end thereof.

4. The electrical device according to claim 1, wherein said load device is a cutter holder.

5. The electrical shaver according to claim 4, wherein said cutter holder includes a rotary-type cutter device rotated by said drive magnet within the housing.

* * * * *